US006298922B1

(12) United States Patent
Stewart

(10) Patent No.: US 6,298,922 B1
(45) Date of Patent: Oct. 9, 2001

(54) DEVICE TO EXTINGUISH BURNING CANDLES

(76) Inventor: Molook Emi Stewart, P.O. Box 764, Ross, CA (US) 94957

( * ) Notice: Subject to any disclaimer, the term of this patent is extended or adjusted under 35 U.S.C. 154(b) by 0 days.

(21) Appl. No.: 09/395,112

(22) Filed: Sep. 14, 1999

Related U.S. Application Data

(63) Continuation-in-part of application No. 09/114,733, filed on Jul. 13, 1998, now Pat. No. 5,971,081.

(51) Int. Cl.[7] ..... A62C 3/00; F23Q 25/00
(52) U.S. Cl. ..... 169/46; 169/54; 431/144
(58) Field of Search ..... 169/54, 91, 43, 169/46, 49, 50; 431/144, 146, 149

(56) References Cited

U.S. PATENT DOCUMENTS

Re. 4,841 * 4/1872 Stow et al. .
849,789 * 4/1907 Hurd ..... 294/99.2
940,832 * 11/1909 Swoger .
1,822,652 * 9/1931 Gluckert .
4,497,374 * 2/1985 Millar ..... 169/46
5,282,737 * 2/1994 Ray ..... 169/46 X
5,989,012 * 11/1999 Umflect ..... 431/144

* cited by examiner

*Primary Examiner*—Lesley D. Morris
(74) *Attorney, Agent, or Firm*—Paul R. Martin

(57) ABSTRACT

A device for extinguishing flames without leaving residual smoke is described. The device is a tweezer like device with wax pads attached to the tips thereof, wherein the wax pads oppose one another. When opposing wax pads are brought together with a burning candle wick there between, the flame of the wick is extinguished without residual smoke being generated.

7 Claims, 3 Drawing Sheets

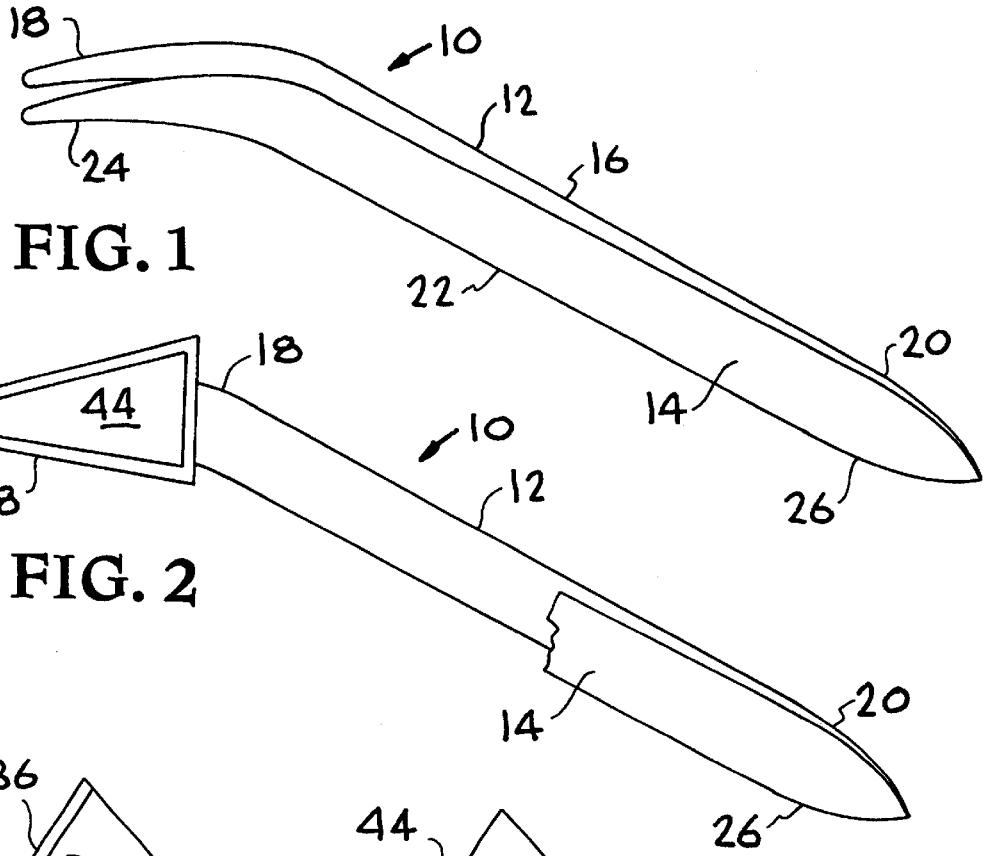
FIG. 1
FIG. 2
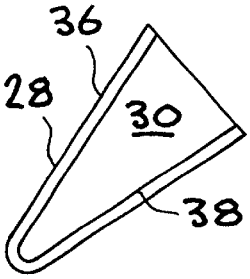
FIG. 3
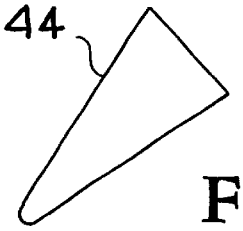
FIG. 4
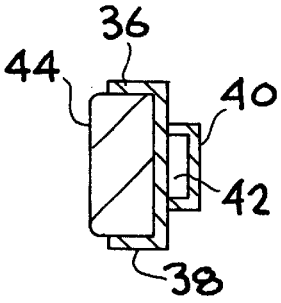
FIG. 5
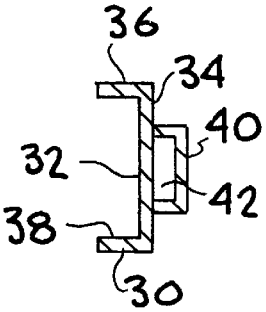
FIG. 6
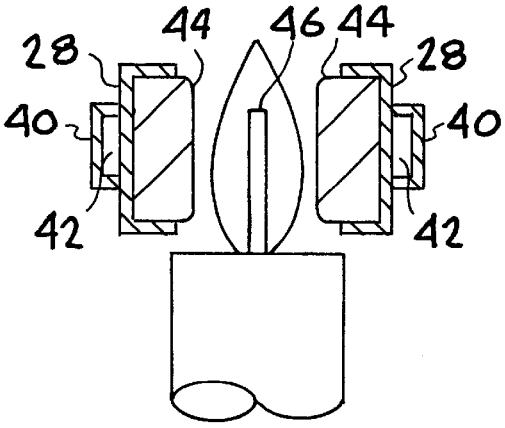
FIG. 7

DEVICE TO EXTINGUISH BURNING CANDLES

RELATED INVENTIONS

This application is a Continuation-In-Part of application Ser. No. 09/114/733, filed Jul. 13, 1998 now U.S. Pat. No. 5,971,081, which is incorporated by reference herein in its entirety.

FIELD OF THE INVENTION

The present invention relates to a device which can be used to extinguish small fires. In particular, it relates to a device which is suitable for use in extinguishing small fires such those associated with the wick of a burning candle, without leaving residual smoke.

BACKGROUND OF THE INVENTION

It is known that many asthmatics and others who have lung diseases such as emphysema, have extreme difficulty breathing in a smoky environment. Even very dilute concentrations of smoke can cause asthmatics to have attacks which can be life threatening. For that reason, asthmatics tend not to burn candles for decorative purposes around the home and elsewhere, because when a burning candle is extinguished using conventional techniques, the wick of the candle will give off substantial quantities of smoke after the actual fire is extinguished. Often times, this residual smoke will trigger an asthma attack.

SUMMARY OF THE INVENTION

The present invention is specifically designed to enable small fires to be extinguished such as those associated with the wicks of candles, without leaving a residue of smoke after the fire is extinguished. Thus, there is provided a smokeless fire extinguishing device. The device has the shape of conventional tweezers, having opposing attachments positioned on the tips thereof which have inwardly facing wax inserts. When it is desired to extinguish the flame of a candle, the tips of the device are positioned on opposite sides of the burning wick of the candle, and then forced together. The wax inserts on the attachments on the tips come into contact with the wick of the candle, extinguishing the flame without there being a smoke residue.

BRIEF DESCRIPTION OF THE DRAWINGS

FIG. 1 is a perspective view of a conventional pair of tweezers which form a part of the device of the invention.

FIG. 2 is a perspective view with parts broken away of the device of the invention, showing a pad mounted on the tip of the device of the invention with an inwardly facing wax insert positioned therein.

FIG. 3 is a perspective view of the attachment for the tip of the device of the invention.

FIG. 4 is a perspective view of the wax insert for the attachment shown in FIG 3.

FIG. 5 is a cross sectional view of the attachment of FIG. 3, showing the wax insert of FIG. 4 inserted in place.

FIG. 6. is a cross sectional view through line 6—6 of FIG. 3 showing the slot configuration used for mounting the attachment onto the tip of the tweezers.

FIG. 7 is a cross sectional view of the extreme forward end of the device of the invention showing a burning wick of a candle positioned there between.

DETAILED DESCRIPTION OF THE INVENTION

Figure 8:
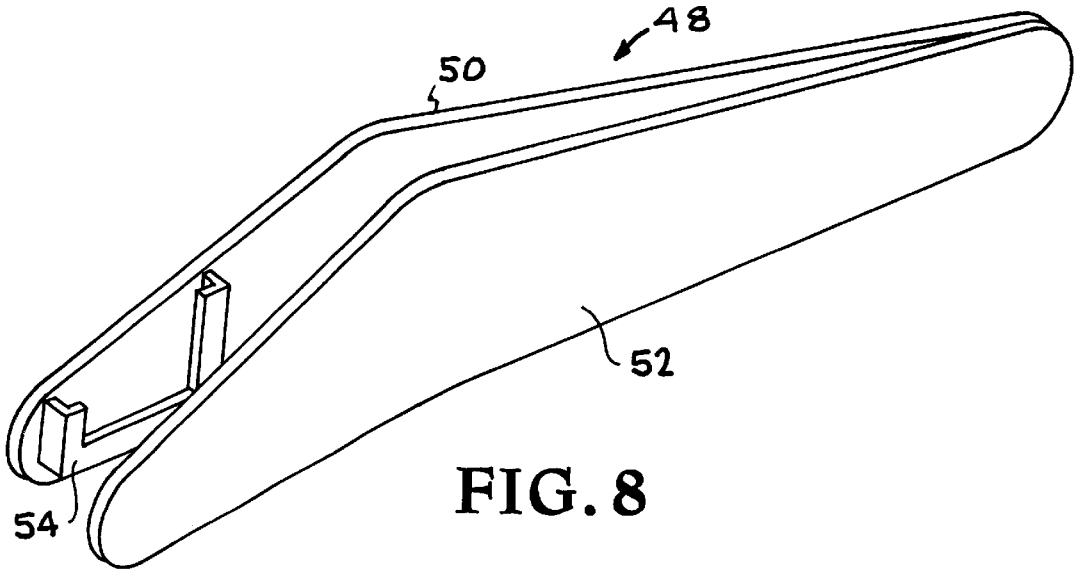
FIG. 8 is a perspective view of an alternative embodiment of the invention.

The present invention comprises, as best seen in FIGS. 1 and 2, a tweezers like device 10 consisting of a pair of identical opposing leaves or blades 12 and 14. Blade 12 has a body portion 16, a forward end 18 and a rearward end 20, and blade 14 has a body portion 22, a forward end 24 and a rearward end 26 . Each blade 12 and 14 tapers to a small point at their respective forward ends 18 and 24. The forward ends 18 and 24 of each blade 12 and 14 are offset at an angle relative to the body portions 16 and 22 respectively. The blades 12 and 14 are permanently attached to each other at their rearward ends 20 and 26, projecting outward from each other at an angle. The angle of diversion is not critical, but generally ranges from about 15 to 20 degrees. In at rest position, the forward ends 18 and 24 of the respective blades are spaced apart from each other. The blades 12 and 14 are made of a flexible material, preferably steel. When desired, the opposing blades 12 and 14 can be grasped with the fingers and urged together.

A removable attachment 28 (FIGS. 2 and 3) is positioned on the forward ends 18 and 24 of each of the blades 12 and 14. The attachment 28 comprises a flat base 30 having top 32 and bottom 34 surfaces with upwardly projecting walls 36 and 38 extending from each side of the base 30. The bottom surface 34 of the base 30 has an additional U shaped channel piece 40 fastened thereto at opposing sides thereof, defining a slot 42 which extends substantially the length of the base. The dimensional configuration of the slot 42 is such that it is adapted to receive the forward ends 18 and 24 of the blades 12 and 14 when the attachment 28 is slipped over the respective ends thereof. The base 30 of the attachment 28 is preferably triangular in shape, although the actual shape is not critical. What is important is that the shape of the slot 42 conform to the shape of the forward ends 18 and 24 of the blades 12 and 14, so that when the attachment 28 is slipped over the forward ends of the blades 12 and 14, the fit is snug.

A removable wax insert 44 (FIGS. 4, 5 and 6) is positioned in that space defined by the base 30 and upwardly projecting walls 36 and 38 of the attachment 28. The wax insert 44 projects above the walls 36 and 38, as best seen in FIGS. 5 and 7. The wax can be of any composition, but is preferably that type of wax used in conventional candies. The was pad should be of sufficient dimension that it encompasses the length of a candle wick when brought into contact with it.

As seen in FIG. 7, the attachments 28 are positioned on the forward ends 18 and 24 of the blades 12 and 14 so that the wax pads 44 art facing inwardly.

In operation, the opposing forward ends 18 and 24 of the device 10, with the inwardly facing removable attachments 28 in place, are positioned such that a burning candle wick 46 is there between (FIG. 7). The blades 12 and 14 are then squeezed together. The wax pads 44 engage the burning wick 46 through its entire length and snuff out the fire. There is no residual smoke.

Figure 9:
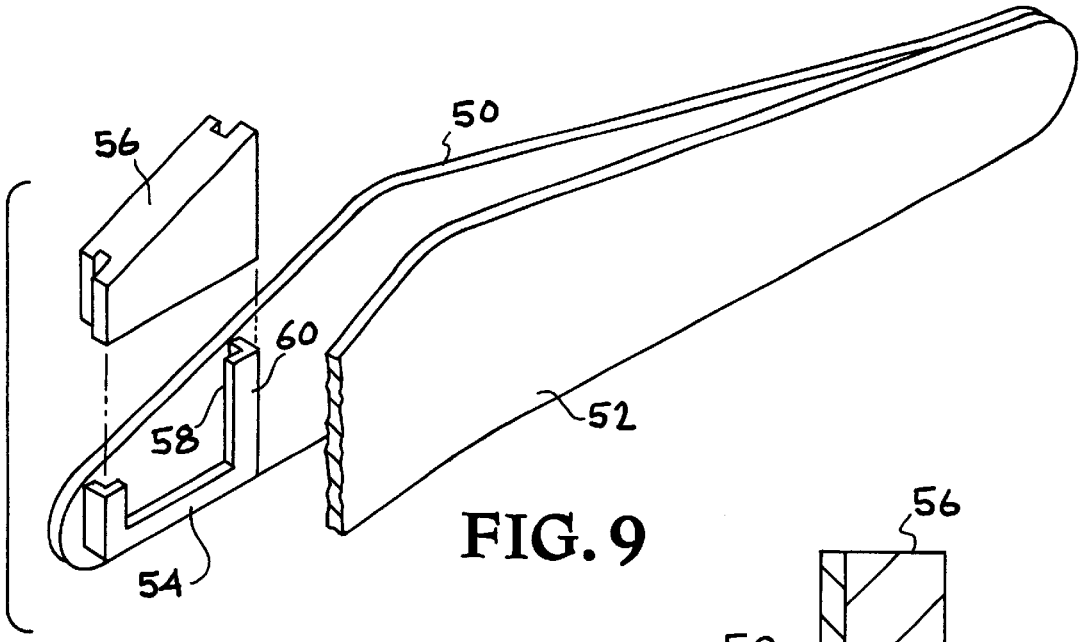
FIG. 9 is a perspective view with portions broken away of the embodiment shown in FIG. 8, illustrating how a wax block slides into the slot means of the embodiment.
Figure 10:
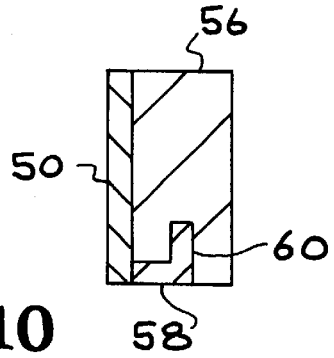
FIG. 10 is a cross section view of the embodiment of FIG. 8 showing the wax block positioned in the slot means.

Another embodiment of the invention is illustrated in FIGS. 8, 9 and 10. This embodiment comprises a tweezers like device 48, which has opposing movable blades 50 and 52, each of which has a forward end and a rearward end. The blades are joined at their rearward ends. On the inner surface of the forward end of each blade, 50 and 52, is positioned slot means 54 for receiving a wax block or insert 56. The slot means 54 is comprised of the inner surface of the forward end of each blade, and a wall 58 projecting perpendicularly from the inner surfaces of the blades 50 and 52. The wall 58 is three sided and is open on the top. At the outer end of the wall 58, is a lip 60, which projects perpendicularly from the end of the wall 58, in an inward direction. Thus, as best seen in FIG. 10, when the wax block 56 is slid into the open face of the slot means 54, the combination of the inner surface of the blade 50 or 52, and the wall 58 with inwardly projecting lip 60, serves to engage the wax block 56, and hold it in place. Instead of using the inner surface of the blade 50 or 52 as one surface of the slot means, a separate unit can be built comprising a base and a wall with an inner projecting lip, to provide means for receiving the wax block. This unit can be attached to the inner surfaces of the blades 5O and 52.

Figure 11:
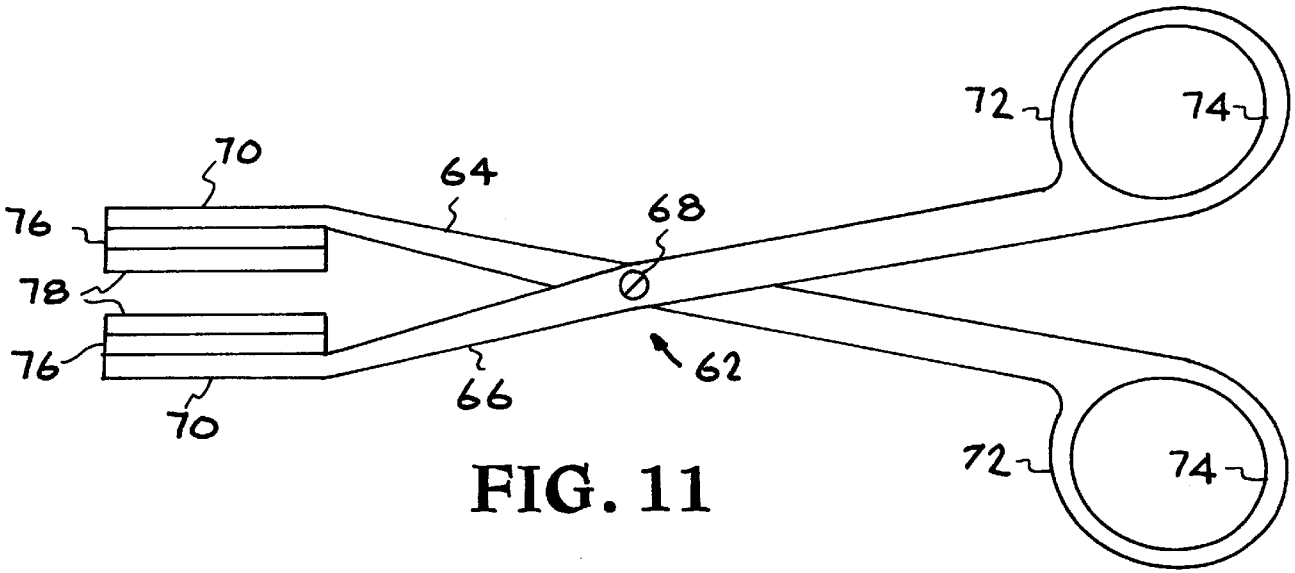
FIG. 11 is a top view of still another embodiment of the invention.
Figure 13:
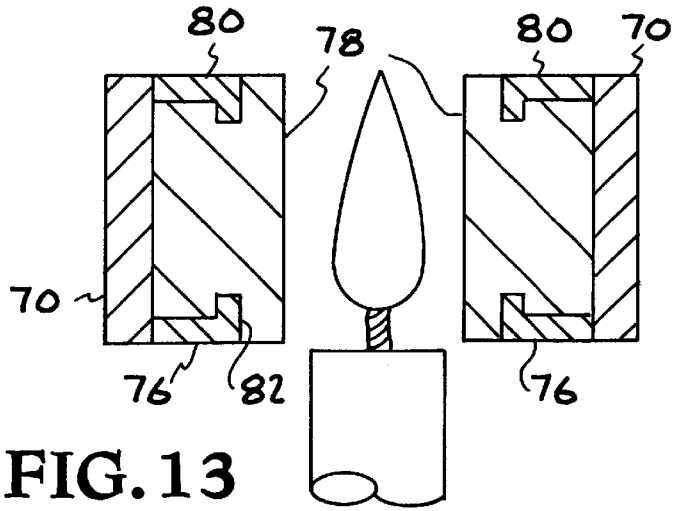
FIG. 13 is a cross sectional end view of the embodiment shown in FIG. 11.
Figure 12:
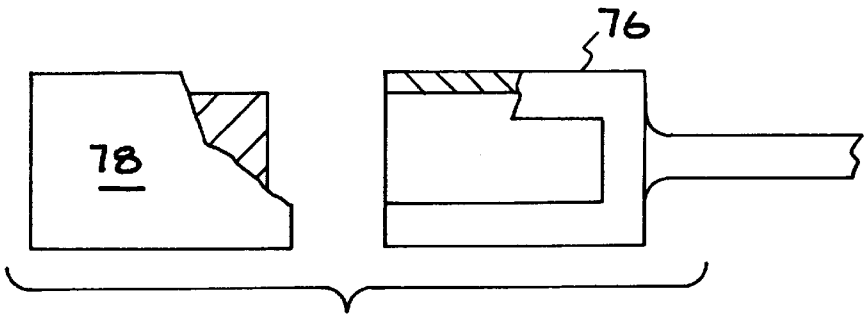
FIG. 12 is a side view of a portion of the embodiment shown in FIG. 11.

Still another embodiment of the invention is shown in FIGS. 11, 12 and 13. As best shown in FIG. 11, this embodiment comprises a tong or scissors like device having two opposing arms 64 and 66 joined together at a pivot 68. The arms 64 and 66 are movable about the pivot 68. Each of the arms 64 and 66 are substantially identical to each other, having a forward end 70 and a rearward end 72. The rearward ends 72 of each arm are shaped like a scissors handle with an opening 74 through which the thumb or a digit can be placed. The forward ends 70 of each arm 64 and 66 have slot means 76 positioned on their respective inner surfaces for receiving a wax block or insert 78. The slot means 76, also known as wax block receiving means, comprises the inner surface of each of the forward ends 70 of the arms 64, 66, and a wall 80, which projects perpendicularly from the inner surface of each arm. At the outer end of the wall is a lip 82, which is perpendicular to the end of the wall 80. The wall 80 is U shaped in configuration, and is open on the front end. The combination of the inner surface of forward end 70 of the arm 64 or 66, the wall 80 and lip 82, combine to form a means for receiving and securing a wax block 78 which is slipped into the slot formed thereby. Thus, as seen in FIG. 13 the wax block 78 is secured within the slot formed by the various surfaces and walls of each arm.

Instead of using the inner surface of the forward ends 70 of the arms 64 and 66 as a component of the slot means, a separate unit can be built comprising a base, a wall projecting therefrom, and an inwardly projecting lip, and this unit can then be attached to the inner surface of the forward ends 70 of each of the arms 64 and 66 to provide means for receiving a wax block.

In operation, after the wax block 78 is inserted into the slot means 76 of each arm 64 and 66, the forward ends of the arms are brought into contact with each other, serving to extinguish a burning candle wick which may be interposed therebetween.

The device according to the present invention has been shown and described with reference to preferred embodiments. However, it should be obvious to one of ordinary skill in the art that modifications or changes made be made to the device while keeping within the scope of the invention as defined in the following claims.

What is claimed is:

1. A method of extinguishing a burning candle wick without leaving residual smoke which comprises enveloping said burning candle wick within opposing blocks of wax, and maintaining said blocks of wax in contact with said wick until said burning wick is extinguished.

2. A device for extinguishing fires comprising:

a tweezers like unit consisting of opposing blades, having forward and rearward ends, said blades being attached to each other at the rearward ends thereof and spaced apart from each other at the forward ends thereof, said blades having wax pads positioned on the inner surfaces of the forward ends of each blade, said blades with wax pads attached being spaced apart in resting position sufficiently to interpose a burning candle wick therebetween, whereby when said blades are urged into contact with each other, the wax pads engage and come into contact with said burning wick, thereby extinguishing the flame associated with said wick without residual smoke.

3. A device for extinguishing fires comprising:

a pair of opposing arms, having forward and rearward ends, said arms being fixedly connected to each other at a point and movable in relation to each other, said arms being spaced apart from each other at the forward ends thereof, said arms having wax pads positioned on the inner surfaces of the forward ends of each arm, said arms with wax pads attached being spaced apart in resting position sufficiently to interpose a burning candle wick therebetween, whereby when the forward ends of said arms are urged into contact with each other, said wax pads engage and come into contact with said burning wick, thereby extinguishing the flame associated with said wick without residual smoke.

4. A device for extinguishing fires comprising:

a tong or scissors like device having pair of opposing arms, said arms having forward and rearward ends, said arms being pivotably connected to each other at a point intermediate said forward and rearward ends, and spaced apart from each other at the forward ends thereof, said arms having wax pads positioned on the inner surfaces of the forward ends of each arm, said arms with wax pads attached being spaced apart in resting position sufficiently to interpose a burning candle wick therebetween, whereby when the forward ends of said arms are urged into contact with each other, said wax pads engage and come into contact with said burning wick, thereby extinguishing the flame associated with said wick without residual smoke.

5. The device of claim 4 wherein the inner surfaces of the forward ends of said arms have slot means for receiving said wax pads.

6. The device of claim 5 wherein said slot means comprises the inner surface of each of said arms, a periferal wall projecting perpendicularly therefrom, U-shaped in configuration, and having an inwardly projecting lip at the outer edge thereof, said wall being open at one end, thereby allowing a wax pad to be inserted into the slot formed by the inner surface of an arm, the wall, and inwardly projecting lip.

7. The device of claim 6 wherein said wall is open to the front end.

* * * * *